US005086925A

United States Patent [19]

Coalier et al.

[11] Patent Number: 5,086,925

[45] Date of Patent: Feb. 11, 1992

[54] PACKAGING MADE OF CARD OR SIMILAR MATERIAL FOR PACKING A PLURALITY OF OBJECTS, A BLANK FOR MAKING SUCH PACKAGING BY FOLDING, AND A METHOD OF MANUFACTURING THE BLANK

[75] Inventors: Guy Coalier, Noce; Jean-Claude Serre, Dijon, both of France

[73] Assignee: Otor, Paris, France

[21] Appl. No.: 668,129

[22] Filed: Mar. 12, 1991

[30] Foreign Application Priority Data

Mar. 12, 1990 [FR] France ..... 90 03118

[51] Int. Cl.[5] ..... B65D 65/00

[52] U.S. Cl. ..... 206/497; 53/441; 53/442; 206/813; 206/491

[58] Field of Search ..... 53/441, 442; 206/497, 206/491

[56] References Cited

U.S. PATENT DOCUMENTS

| | | | |
|---|---|---|---|
| 3,226,236 | 12/1965 | Weller | 99/171 |
| 3,669,337 | 6/1972 | Struble | 206/497 |
| 3,987,897 | 10/1976 | Smith | 206/497 |
| 4,087,003 | 5/1978 | Adamek | 206/497 |
| 4,133,430 | 1/1979 | Cravens | 206/497 |
| 4,285,432 | 8/1981 | de Villers et al. | 206/497 |
| 4,306,653 | 12/1981 | Fales | 206/497 |
| 4,328,896 | 5/1982 | Behne | 206/497 |
| 4,757,900 | 7/1988 | Misset et al. | 206/497 |

FOREIGN PATENT DOCUMENTS

| | | |
|---|---|---|
| 0225208 | 6/1987 | European Pat. Off. . |
| 1776769 | 8/1958 | Fed. Rep. of Germany . |
| 2426620 | 12/1979 | France . |

*Primary Examiner*—William I. Price

*Attorney, Agent, or Firm*—Fisher, Christen & Sabol

[57] ABSTRACT

Packaging made of card or similar material for packing a plurality of objects, the packaging comprising a body having a ring of sides and a bottom, thereby defining a volume for receiving said objects, and at least one sheet of shrinkable synthetic material fixed to said body for covering said plurality of objects and for holding the objects in place in said volume by said sheet being shrunk, said bottom being constituted by a plurality of flaps each of which is connected via a corresponding fold line to the bottom longitudinal edge of said ring of sides, said sheet being fixed to at least one of said bottom flaps which is covered, at least in part, by at least one other one of said bottom flaps is such a manner as to clamp said sheet between said flaps.

19 Claims, 2 Drawing Sheets

PACKAGING MADE OF CARD OR SIMILAR MATERIAL FOR PACKING A PLURALITY OF OBJECTS, A BLANK FOR MAKING SUCH PACKAGING BY FOLDING, AND A METHOD OF MANUFACTURING THE BLANK

The present invention relates to packaging made of card or similar material for packing a plurality of objects, to a blank for making said packaging by folding, and to a method of manufacturing said blank.

BACKGROUND OF THE INVENTION

Packing a plurality of identical or different objects in a common container gives rise to a problem of preventing said objects from moving inside the container when the objects do not occupy all of the available space. To this end, it is presently common practice to fill the voids that remain inside packaging after objects have been inserted with filler material such as cellulose fiber, paper, various cellular products, etc. Each of these materials suffers from special drawbacks related to its specific nature, plus the common drawback of needing to be removed on unpacking. To avoid these drawbacks, proposals have been made to use two sheets of shrinkable synthetic material covering said objects, with first ends of the sheets being fixed inside the packaging and with overlapping free second ends being fixed to one another, after which the synthetic material is heated to cause the sheets to shrink onto said objects.

However, fixing said sheets in a simple manner (e.g. by means of glue) inside the packaging is often not strong enough to withstand the various stresses to which the packaging may be subjected during handling, and as a result the bonds between the sheets and the packaging break, thereby enabling the contents to escape from the packaging, or at the very least leaving the objects free to move about inside the packaging. Various contrivances have been used to reinforce the fixing of said sheets in order to avoid said risk. However, such contrivances are generally complicated, thereby increasing the cost of manufacturing the packaging.

An object of the present invention is to avoid these drawbacks by providing packaging in which the sheets of shrinkable synthetic material remain fixed regardless of the stresses to which the packaging may be subjected during handling, and this is done simply and without increasing the cost of the packaging.

SUMMARY OF THE INVENTION

To this end, the present invention provides packaging made of card or similar material for packing a plurality of objects, the packaging comprising a body having a ring of sides and a bottom, thereby defining a volume for receiving said objects, and at least one sheet of shrinkable synthetic material fixed to said body for covering said plurality of objects and for holding the objects in place in said volume by said sheet being shrunk, said bottom being constituted by a plurality of flaps each of which is connected via a corresponding fold line to the bottom longitudinal edge of said ring of sides, said sheet being fixed to at least one of said bottom flaps which is covered, at least in part, by at least one other one of said bottom flaps in such a manner as to clamp said sheet between said flaps.

Thus, the sheet of shrinkable synthetic material is held firmly between said flaps, particularly since the weight of the objects contained in the packaging contributes to holding the sheet firmly, and this is achieved without resorting to complicated contrivances which have ended up by being expensive in the past.

Although said sheet could be fixed to the outside face of a flap it is preferable for said sheet to be fixed to the inside face of at least one of said bottom flaps.

Advantageously, said sheet is fixed parallel to the longitudinal edge of said ring of sides.

In particular, said bottom flap to which said sheet is fixed may have at least one of the flaps adjacent thereto lying thereover.

When the packaging includes two of said sheets of shrinkable synthetic material with first ends thereof being fixed to said body and with free second ends thereof overlapping one another for the purpose of being fixed together prior to said sheets being shrunk onto said objects, said bottom is made up of first and second pairs of opposite flaps, with the first ends of said sheets being fixed to respective flaps in the first pair of bottom flaps and with the second pair of bottom flaps overlying the flaps of said first pair so as to clamp said first ends of said sheets between said first and second pairs of bottom flaps.

Further, it is advantageous for sheet fixing to be performed in the vicinity of the bottom longitudinal edge of said ring of sides, and/or for said sheet fixing to be by gluing.

The invention also relates to a blank for making the above-defined packaging by folding, said blank comprising, according to the invention:

a net of card or similar material in the form of an elongate strip having a first longitudinal portion subdivided into a plurality of adjacent panels by transverse fold lines, each adjacent panel being intended to form one of the faces of the ring of sides of the packaging, and a second longitudinal portion connected to said first longitudinal portion via a fold line and subdivided by line cuts into a plurality of adjacent flaps for forming the bottom of said packaging; and at least one sheet of shrinkable synthetic material fixed to at least one of said flaps.

Preferably, said sheet is fixed parallel to the fold line interconnecting said first and second longitudinal portions and extends towards that one of the panels of said first longitudinal portion that extends the flap to which said sheet is fixed.

In particular, said net includes four of said side portions, each corresponding to a bottom flap, and wherein two of said sheets of shrinkable synthetic material are provided and are fixed to a first flap and a second flap respectively, which first and second flaps are separated by a third flap.

Advantageously, each sheet is fixed to the corresponding flap in the vicinity of the fold line connecting said flap to the corresponding panel, and/or each sheet is fixed to the corresponding flap by gluing.

One end of said first longitudinal portion may be extended by a small flap.

The invention also provides a method of manufacturing the above-described blank comprising:

a) cutting out a net of card or similar material in the form of an elongate strip having a first longitudinal portion split up into a plurality of adjacent panels by transverse fold lines, each panel being intended to form one of the faces of the ring of sides of the packaging, and a second longitudinal portion connected to said first longitudinal portion by a fold line and subdivided by line cuts into a plurality of adjacent flaps for forming the bottom of the packaging; and b) fixing at least one sheet of shrinkable synthetic material to at least one of said flaps.

Advantageously, said sheet is fixed parallel to the fold line connecting said first and second portions together, said sheet extending towards the panel of said first longitudinal portion that extends said flap.

In one particular case:

said first longitudinal portion is subdivided into four adjacent panels each having a flap of said second longitudinal portion corresponding thereto, and two of said sheets of shrinkable synthetic material are respectively fixed to a first flap and to a second flap, said first and second flaps being separated by a third flap.

Preferably, each sheet is paid-out from a roll and cut to the desired length.

In particular, each sheet is fixed to the corresponding flap in the vicinity of the fold line connecting said flap to the corresponding panel, and/or each sheet is fixed to the corresponding flap by gluing.

BRIEF DESCRIPTION OF THE DRAWINGS

An embodiment of the invention is described by way of example with reference to the accompanying drawings, in which.

MORE DETAILED DESCRIPTION

Figure 1:
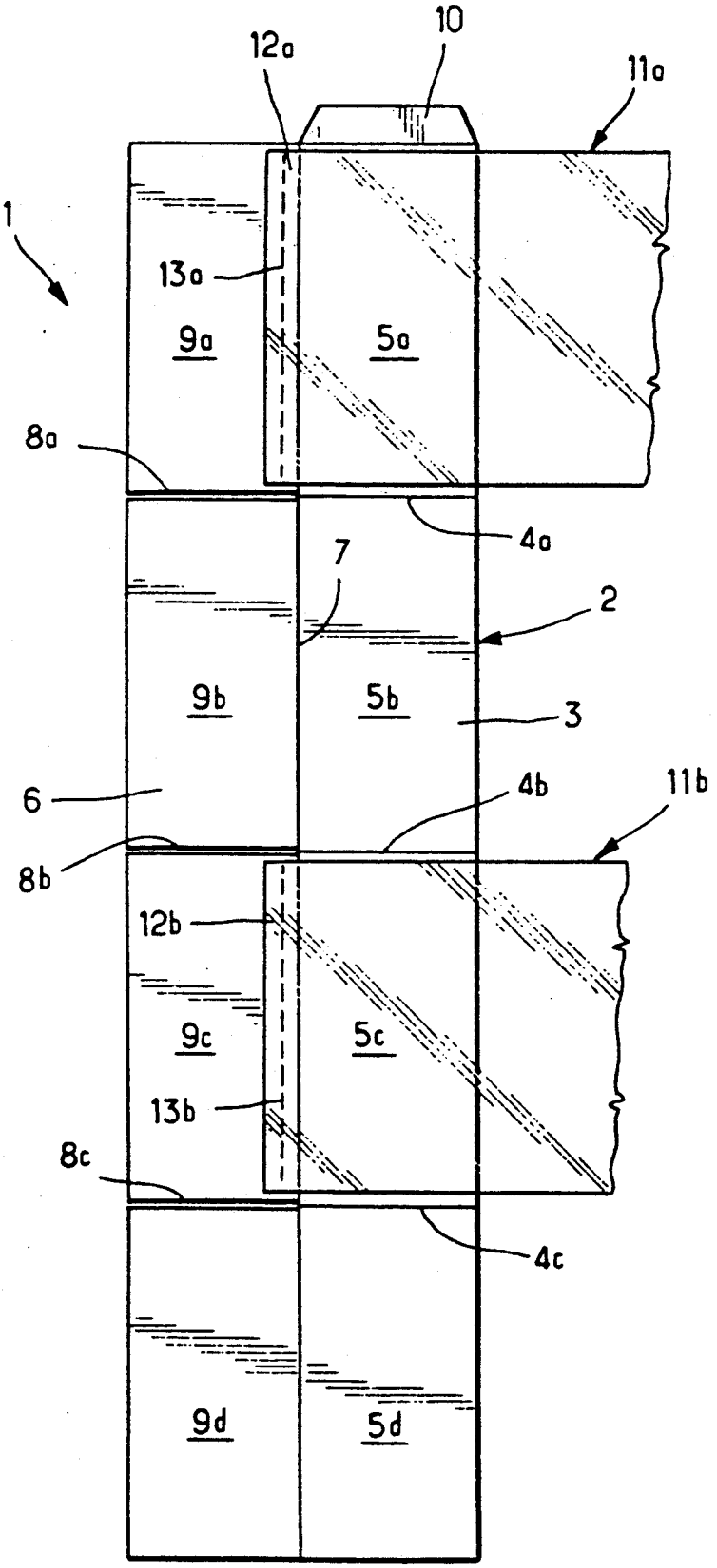
FIG. 1 is a plan view of one embodiment of a blank from which packaging of the invention is made.

With reference to FIG. 1, packaging of the invention is made from a blank 1 comprising a net 2 made of card or similar material in the form of an elongate strip having a first longitudinal portion 3 separated into four adjacent panels 5*a*, 5*b*, 5*c*, and 5*d* by transverse fold lines 4*a*, 4*b*, and 4*c*, with each of the four adjacent panels being intended to form a corresponding side face of the packaging. The net 2 also has a second longitudinal portion 6 connected to the first portion 3 by a fold line 7 and subdivided by line cuts 8*a*, 8*b*, and 8*c* into four flaps 9*a*, 9*b*, 9*c*, and 9*d* that are intended to form the bottom of the packaging. In addition, the net 2 includes a small flap 10 extending one end of the first longitudinal portion 3 and intended to fix together the two ends of the run of four sides of the packaging to form a ring of sides.

In addition, two sheets 11*a* and 11*b* of shrinkable synthetic material are fixed via first ends 12*a* and 12*b* thereof to respective flaps 9*a* and 9*c* on either side of a third flap 9*b*, i.e. to two flaps that will be opposite each other when the packaging is formed. It would thus be equally possible to fix the sheets 11*a* and 11*b* to the flaps 9*b* and 9*d*, respectively. More precisely, said first ends 12*a* and 12*b* are fixed to the corresponding flaps 9*a* and 9*c* parallel to the fold line 7 and advantageously in the vicinity thereof, e.g. by gluing as is represented in FIG. 1 by dashed lines 13*a* and 13*b*. Naturally, each sheet could equally well be glued to any portion of the flap or even to the entire flap.

To obtain the blank, the net 2 is initially cut out so as to obtain the configuration described with reference to FIG. 1, then the lines of glue 13*a* and 13*b* are applied, after which the said sheets 11*a* and 11*b* of shrinkable synthetic material are fixed in place, which sheets are advantageously obtained by cutting off appropriate lengths from a roll of sheet material.

Figure 2:
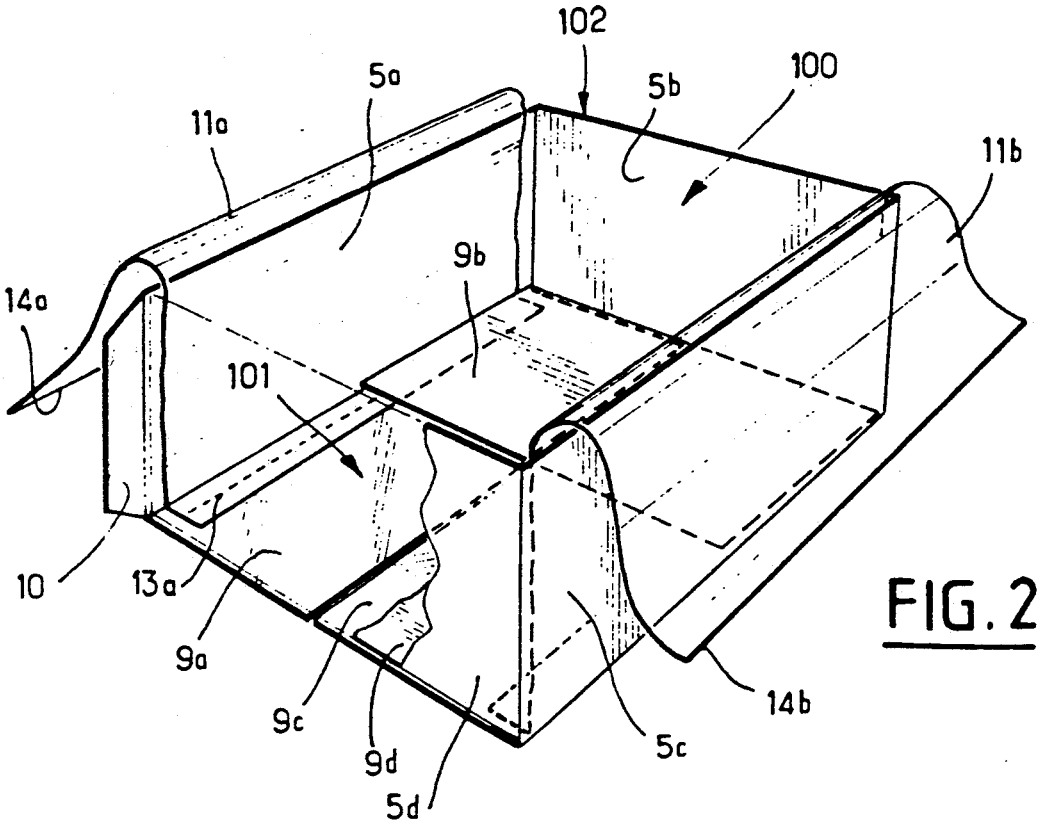
FIG. 2 is a partially cut away perspective view of the packaging made from the blank of FIG. 1.

With reference now to FIG. 2, it can be seen that the packaging 100 of the invention is obtained by folding the blank 1 of FIG. 1. More precisely, the bottom 101 of the packaging 100 is obtained by folding the flaps 9*a* & 9*c* and 9*b* & 9*d* towards each other in pairs so that the flaps 9*a* and 9*c* on which the sheets 11*a* and 11*b* are fixed lie under the flaps 9*b* and 9*d* which thus clamp the ends 12*a* and 12*b* of said sheets 11*a* and 11*b* between the flap 9*a* or 9*c* and the two flaps 9*b* and 9*d* adjacent thereto. As already mentioned, this makes it possible to hold each sheet firmly between the bottom flaps without running the risk of the sheet being torn off while the packaging is being handled.

While the bottom flaps 9*a* to 9*d* are being folded, the panels 5*a* to 5*d* of the net 2 are folded simultaneously so as to form the ring of four sides 102 for the packaging 100, with the two ends of the net being fixed together by means of the small flap 10.

Figure 3:
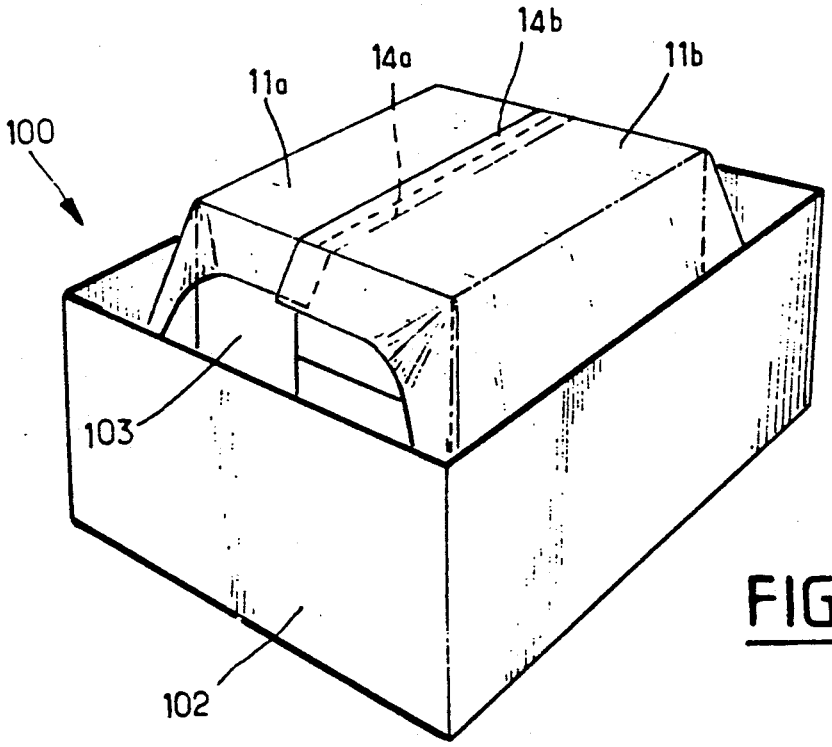
FIG. 3 is a perspective view of the packaging of FIG. 2 having objects placed therein.

As shown in FIG. 2, the sheets 11*a* and 11*b* extend from the bottom 101 along a respective one of the inside faces of the ring of side walls 102 and beyond the tops of said faces so that their free ends 14*a* and 14*b* can be caused to lie one over the other and can then be fixed together with said sheets 11*a* and 11*b* covering objects 103 placed in the packaging 100 (FIG. 3). The objects 103 are held firmly in place in the packaging 100 by the sheets 11*a* and 11*b* being shrunk onto the objects, and in addition the weight of the objects 103 participates in retaining each sheet clamped between bottom flaps.

We claim:

1. Packaging made of card or similar material for packing a plurality of objects, the packaging comprising a body having a ring of sides and a bottom, thereby defining a volume for receiving said objects, and at least one sheet of shrinkable synthetic material fixed to said body for covering said plurality of objects and for holding the objects in place in said volume by said sheet being shrunk, said bottom being constituted by a plurality of flaps each of which is connected via a corresponding fold line to the bottom longitudinal edge of said ring of sides, said sheet being fixed to at least one of said bottom flaps which is covered, at least in part, by at least one other one of said bottom flaps in such a manner as to clamp said sheet between said flaps.

2. Packaging according to claim 1, in which said sheet is fixed to the inside face of at least one of said bottom flaps.

3. Packaging according to claim 1, in which said sheet is fixed parallel to the longitudinal edge of said ring of sides.

4. Packaging according to claim 1, in which said bottom flap to which said sheet is fixed has at least one of the flaps adjacent thereto lying thereover.

5. Packaging according to claim 1, including two of said sheets of shrinkable synthetic material with first ends thereof being fixed to said body and with free second ends thereof overlapping one another for the purpose of being fixed together prior to said sheets being shrunk onto said objects, wherein said bottom is made up of first and second pairs of opposite flaps, with the first ends of said sheets being fixed to respective flaps in the first pair of bottom flaps and with the second pair of bottom flaps overlying the flaps of said first pair so as to clamp said first ends of said sheets between said first and second pairs of bottom flaps.

6. Packaging according to claim 1, in which sheet fixing is performed in the vicinity of the bottom longitudinal edge of said ring of sides.

7. Packaging according to claim 1, in which sheet fixing is performed by gluing.

8. A blank for making packaging according to claim 1, the blank comprising:

a net of card or similar material in the form of an elongate strip having a first longitudinal portion subdivided into a plurality of adjacent panels by transverse fold lines, each adjacent panel being intended to form one of the faces of the ring of sides of the packaging, and a second longitudinal portion connected to said first longitudinal portion via a fold line and subdivided by line cuts into a plurality of adjacent flaps for forming the bottom of said packaging; and at least one sheet of shrinkable synthetic material fixed to at least one of said flaps.

9. A blank according to claim 8, in which said sheet is fixed parallel to the fold line interconnecting said first and second longitudinal portions and extends towards that one of the panels of said first longitudinal portion that extends the flap to which said sheet is fixed.

10. A blank according to claim 8, in which said net includes four of said panels, each corresponding to a bottom flap, and wherein two of said sheets of shrinkable synthetic material are provided and are fixed to a first flap and a second flap respectively, which first and second flaps are separated by a third flap.

11. A blank according to claim 10, in which each sheet is fixed to the corresponding flap in the vicinity of the fold line connecting said flap to the corresponding panel.

12. A blank according to claim 8, in which sheet fixing is performed by gluing.

13. A blank according to claim 8, in which one end of said first longitudinal portion is extended by a small flap.

14. A method of manufacturing a blank according to claim 8, the method comprising the steps of:

a) cutting out a net of card or similar material in the form of an elongate strip having a first longitudinal portion split up into a plurality of adjacent panels by transverse fold lines, each panel being intended to form one of the faces of the ring of sides of the packaging, and a second longitudinal portion connected to said first longitudinal portion by a fold line and subdivided by line cuts into a plurality of adjacent flaps for forming the bottom of the packaging; and b) fixing at least one sheet of shrinkable synthetic material to at least one of said flaps.

15. A method according to claim 14, wherein said sheet is fixed parallel to the fold line connecting said first and second portions together, said sheet extending towards the panel of said first longitudinal portion that extends said flap.

16. A method according to claim 14, in which said first longitudinal portion is subdivided into four adjacent panels each having a flap of said second longitudinal portion corresponding thereto, and in which two of said sheets of shrinkable synthetic material are respectively fixed to a first flap and to a second flap, said first and second flaps being separated by a third flap.

17. A method according to claim 14, in which each sheet is paid-out from a roll and cut to the desired length.

18. A method according to claim 14, in which each sheet is fixed to the corresponding flap in the vicinity of the fold line connecting said flap to the corresponding panel.

19. A method according to claim 14, in which each sheet is fixed to the corresponding flap by gluing.

* * * * *